United States Patent [19]

Etzbach et al.

[11] 3,970,441

[45] July 20, 1976

[54] CASCADED REFRIGERATION CYCLES FOR LIQUEFYING LOW-BOILING GASEOUS MIXTURES

[75] Inventors: Volker Etzbach, Munich; Wolfgang Förg, Grunwald; Peter Grimm, Munich, all of Germany

[73] Assignee: Linde Aktiengesellschaft, Wiesbaden, Germany

[22] Filed: Jan. 13, 1975

[21] Appl. No.: 540,535

Related U.S. Application Data

[63] Continuation-in-part of Ser. No. 489,245, July 17, 1974, abandoned.

[30] Foreign Application Priority Data

July 17, 1973 Germany ..... 2336273

[52] U.S. Cl. ..... 62/28; 62/40; 62/54; 62/9

[51] Int. Cl.[2] ..... F25J 3/02

[58] Field of Search ..... 62/9, 40, 11, 23, 24, 62/31, 32, 34, 41, 13, 17, 18, 36, 27, 42, 54, 500, 28

[56] References Cited

UNITED STATES PATENTS

| | | | |
|---|---|---|---|
| 3,212,276 | 10/1965 | Eld et al. | 62/21 |
| 3,418,819 | 12/1968 | Grumburg et al. | 62/11 |
| 3,592,015 | 7/1971 | Streich | 62/28 |
| 3,596,472 | 8/1971 | Streich | 62/28 |
| 3,721,099 | 3/1973 | Forg et al. | 62/29 |
| 3,733,838 | 5/1973 | Delahunty | 62/54 |
| 3,763,658 | 10/1973 | Gaumer | 62/40 |
| 3,808,826 | 5/1974 | Harper et al. | 62/9 |
| 3,818,714 | 6/1974 | Etzbach | 62/11 |

FOREIGN PATENTS OR APPLICATIONS

| | | | |
|---|---|---|---|
| 895,094 | 5/1962 | United Kingdom | 62/9 |

*Primary Examiner*—Frank W. Lutter
*Assistant Examiner*—Frank Sever
*Attorney, Agent, or Firm*—Millen, Raptes & White

[57] ABSTRACT

Process for the at least partial liquefaction of a low-boiling gaseous mixture, which is under pressure, wherein the gaseous mixture is precooled in heat exchange with a vaporizing refrigerant, purified during the course of the precooling step, and, after the precooling step, is subjected to a preliminary separation, characterized in that the at least partial liquefaction of the gaseous fraction obtained during the preliminary separation is carried out in heat exchange with a vaporizing multicomponent gas, the partial liquefaction of which takes place by precooling, and the completed liquefaction and subcooling of which takes place in one stage against itself.

16 Claims, 3 Drawing Figures

CASCADED REFRIGERATION CYCLES FOR LIQUEFYING LOW-BOILING GASEOUS MIXTURES

This application is a continuation-in-part of application Ser. No. 489,245 filed July 17, 1974, now abandoned under the same title and by the same inventors.

This invention relates to a process for the at least partial liquefaction of a low-boiling gaseous mixture, which is under pressure, wherein the gaseous mixture is precooled in heat exchange with a vaporizing refrigerant, purified during the course of the precooling step, and, after the precooling process, is subjected to a preliminary separaton.

A process for the liquefaction of natural gas has been known wherein the required amount of refrigeration is made available by the combination of a three-stage propane cascade with a two-stage mixture cycle (DOS [German Unexamined Laid-Open Application] 1,960,301). According to this conventional process, the natural gas is subjected, after flowing through the first and second stages of the propane cycle, to a benzene scrubbing step in a washing column, to separate the higher-boiling hydrocarbons. The reflux for the washing column is produced by partial condensation of the head product of the column, taking place in heat exchange with the third stage of the propane cascade, and by subsequent phase separation. While the sump product of the washing column, still enriched with methane, is fed to a fractionation unit, the gaseous fraction obtained during the phase separation is liquefied in heat exchange with a two-stage mixture cycle. In the mixture cycle, the multicomponent gas is cooled in heat exchange with the propane cascade, partially liquefied, and subsequently subjected to a phase separation. The liquid fraction obtained during the phase separation is subcooled, expanded, and thereupon vaporized, the thus-produced cold being utilized for the liquefaction of the preliminarily fractionated natural gas, for the subcooling of the liquid fraction, and for the liquefaction of the gaseous fraction produced during the phase separation. The gaseous fraction is likewise subcooled in a further heat exchanger, expanded, and vaporized. The refrigeration obtained during this procedure serves for subcooling the preliminarily separated natural gas and the gaseous fraction obtained during the phase separation. After evaporation and partial warming, both fractions are recombined and again fed to the cycle compressor.

The most essential disadvantage of the conventional process resides in the concept of the mixture cycle, requiring a complicated and extensive apparatus, due to the necessary separator and at least two expansion valves with two heat exchangers with a corresponding distribution system. Additionally, the known process yields a sump product during the preliminary separation of the natural gas which is not free of methane, so that an additional methane separation unit (demethanizer) is required for the sump product in the separation unit wherein the individual components of the mixture cycle are processed.

This invention is based on the problem of developing a simple process for the liquefaction of a gaseous mixture, particularly natural gas.

This problem is solved by conducting the at least partial liquefaction of the gaseous fraction otained during the preliminary separation in heat exchange with an evaporating multicomponent gas, the partial liquefaction of the latter being effected by precooling, and the total liquefaction and subcooling thereof being conducted in one stage countercurrently with itself.

The most essential advantage of the process of this invention resides in the simple manner in which the refrigeration, required at least for the partial liquefaction of the gaseous mixture obtained during the preliminary separation step, is obtained and made available. Due to the fact that the liquefaction and subcooling of the multicomponent gas takes place in one stage, it is possible to eliminate the complicated phase separation, known from the prior art, of the multicomponent gas in a separate fractionator, as well as the provision of several throttle valves and several heat exchangers. Besides, the number of cross sections and distributor plates is reduced which is required in the peak-cold generator, i.e. in the heat exchanger effecting the heat exchange of the gaseous mixture with the multicomponent gas.

Advantageously, the multicomponent gas is conducted in a closed cycle, wherein the multicomponent gas is first conventionally compressed and cooled and partially liquefied in heat exchange with the refrigerant. The complete liquefaction and subcooling, if any, of the multicomponent gas are thereupon conducted in heat exchange with expanded multicomponent gas which is vaporized in a single stage. After the vaporization and partial warming, the multicomponent gas is reintroduced into the cycle compressor which advantageously is a turbocompressor. The great advantage of the concept of the mixture cycle according to the present invention resides in that this cycle does not contain any buffers within the apparatus, such as separators, for example. In this way, permanent density fluctuations within the cycle gas are lessened, so that the use of a simple turbocompressor as the cycle compressor is possible without risk.

After the gaseous mixture has been at least partially liquefied in heat exchange with the multicomponent gas, it is expanded to a slight excess pressure and subjected to a further phase separation in a separator. The liquid fraction obtained in the separator is expanded, as the product, directly into a storage tank or intermediate tank which is approximately under atmospheric pressure, while the gaseous fraction is utilized for the partial condensation of the gaseous mixture produced during the preliminary separation, the slight excess pressure of this fraction being just sufficient for compensating for the pressure losses incurred while passing through the plant. The condensate obtained during the partial condensation of the gaseous mixture is recycled, as reflux, into the preliminary separating column. Due to the large amount of reflux obtained by this mode of operation, the sump of the preliminary separating column can be heated very strongly, with the consequence that the liquid product to be withdrawn from the preliminary separation column sump contains exclusively high-boiling components of the gaseous mixture. In case of natural gas liquefaction, this means that the sump product of the preliminary separating column no longer contains any methane, whereby the processing of this sump product in a fractionation unit is greatly simplified.

According to a further feature, the expansion of the gaseous mixture, which has been at least partially liquefied in heat exchange with the multicomponent gas, takes place in the separator by means of an ejector, wherein the intake side of the ejector is fed with the vapor obtained during the expansion of the liquid phase produced in the separator to the storage pressure. In this way, it is possible to make the cold of the vapor available for the plant without the additional utilization of a complicated cold blower.

If it is desired to separate an undesired, low-boiling component from the gaseous mixture at least partially liquefied in heat exchange with the multicomponent gas, which, in case of natural gas, is nitrogen, for example, the gaseous mixture can be expanded into a rectifying column which is under slight excess pressure; the residual gas obtained in the head of this column in this case is used for the partial condensation of the gaseous mixture produced during the preliminary separation. The further warming of the residual gas to approximately ambient temperature is accomplished in the heat exchangers of the precooling stage. Here again, the excess pressure of the additional rectifying column is dimensioned so that it is just sufficient for compensating for the pressure drop of the residual gas when flowing through the various heat exchanger cross sections.

The desired liquefied gaseous mixture is, in this case, withdrawn as the product from the sump of the rectifying column and, after expansion to storage pressure, fed to a separate storage tank. To make it possible to exploit the cold of the vapor obtained during this expansion for purposes of the plant without the expensive use of an additional cold blower, another feature of this invention provides that the at least partially liquefied gaseous mixture to be separated is expanded into the rectifying column by means of an ejector, the intake side of the ejector being fed with the vapor obtained during the expansion of the sump product of the column to the storage pressure, which vapor is separated from the liquid phase, for example, in a separator inserted between the rectifying column and a storage tank.

The process of this invention is particularly advantageously suitable for obtaining a liquid component consisting essentially of methane from natural gas.

Additional explanations of the invention can be derived from the embodiments schematically illustrated in the drawings, to wit:

Figure 1:
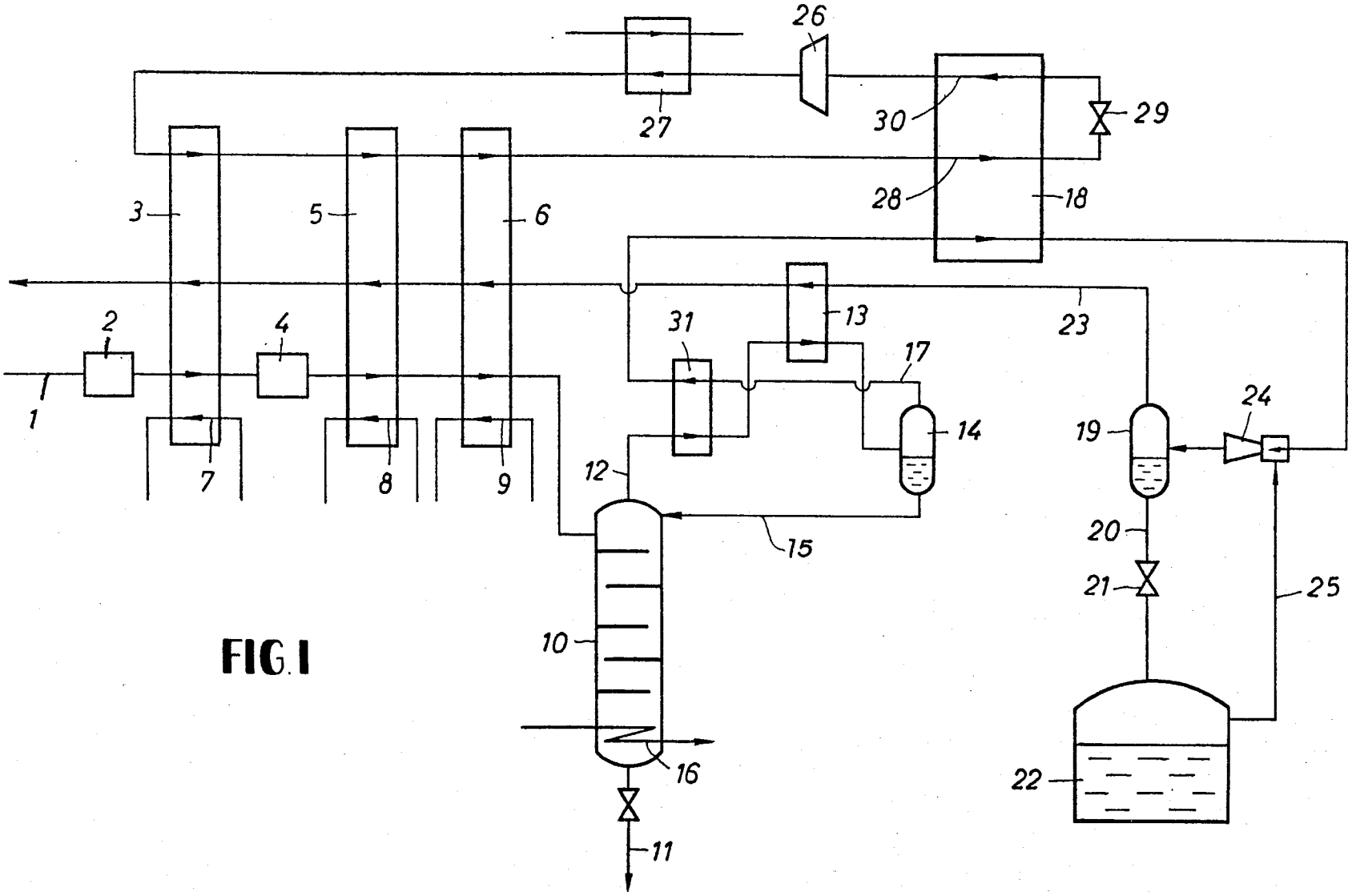
FIG. 1 is a process scheme for the liquefaction of nitrogen-free natural gas.
Figure 2:
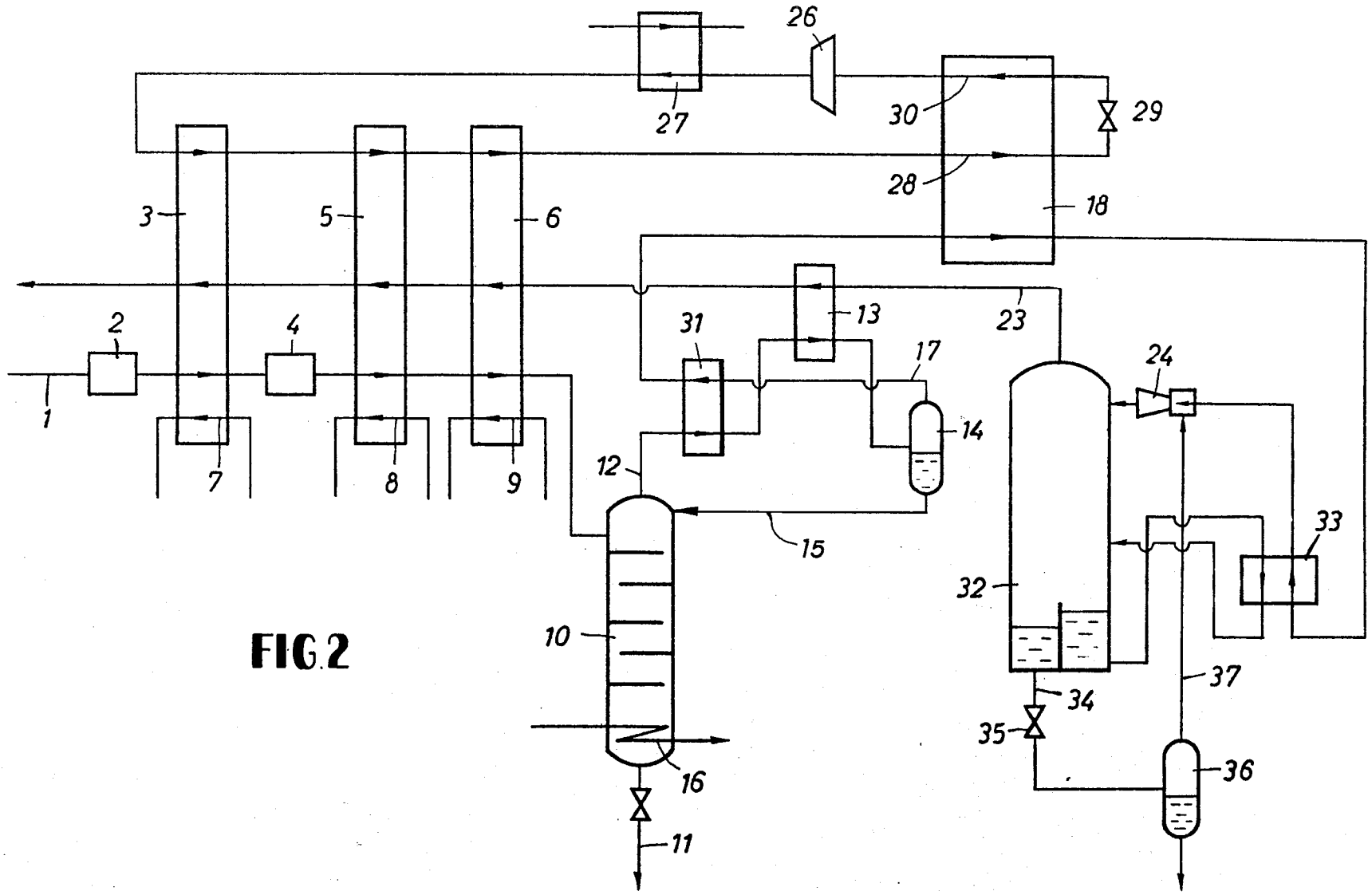
FIG. 2 is a process scheme for the liquefaction of nitrogen-containing natural gas.
Figure 3:
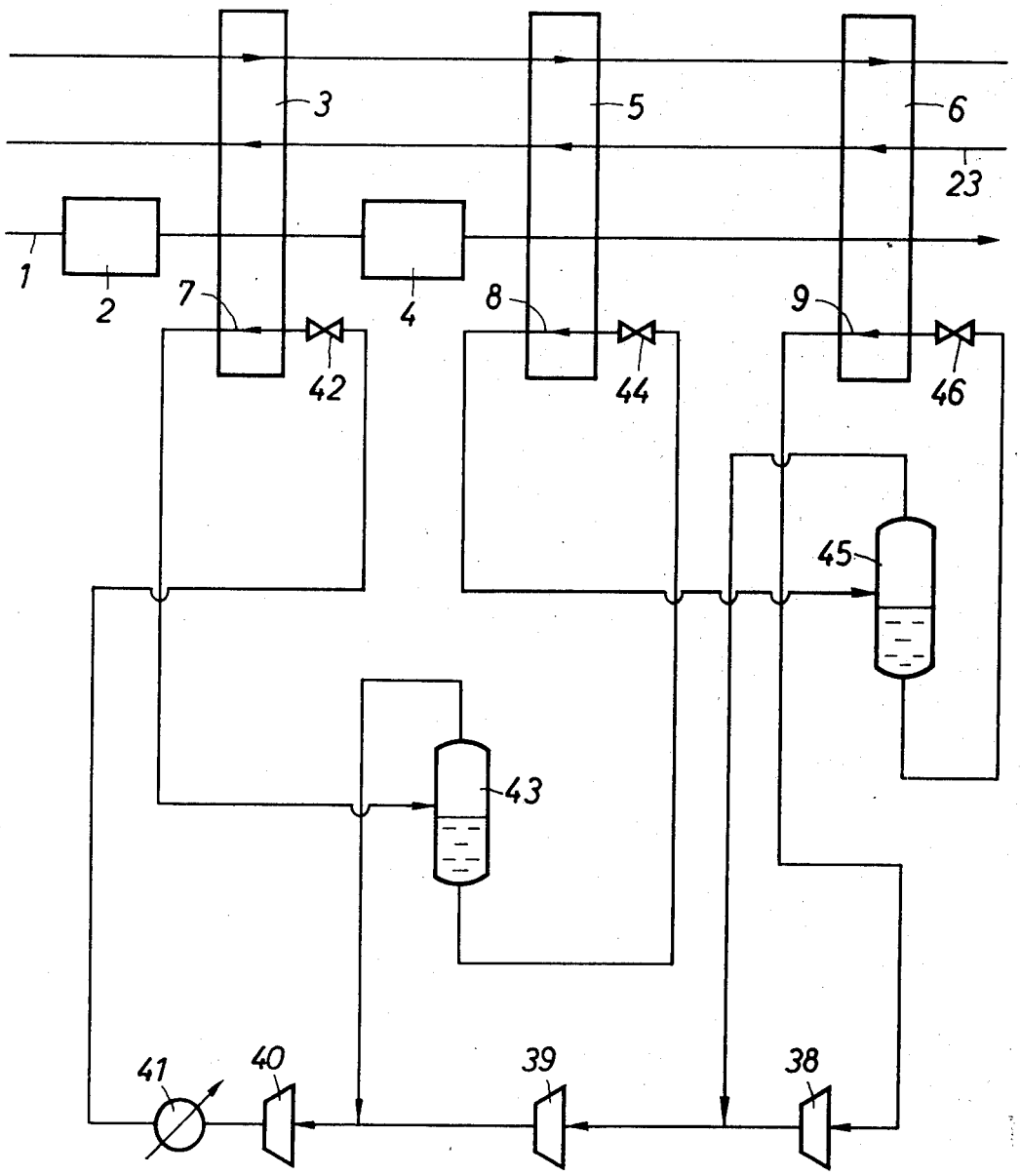

FIG. 3 is a process scheme for the 3-stage propane cascade omitted from FIGS. 1 and 2. de According to FIG. 1, natural gas to be liquefied, which is compressed to about 44 atmospheres absolute and consists in this example essentially of methane, ethane, propane, and higher-boiling hydrocarbons, is fed to the plant via conduit 1, subjected to a $CO_2$-separation step in the purifier 2, cooled in heat exchanger 3, subjected to an $H_2O$-separation in the purifier 4, and partially liquefied in heat exchangers 5 and 6. The refrigeration required for the partial liquefaction of the entering natural gas is made available by a refrigerant evaporating in the heat exchanger cross sections 7, 8 and 9. Advantageously, this refrigerant is propane conducted in a three-stage cascasde. The heat exchanger cross sections, 7, 8, and 9 correspond in this case to the individual cold levels of the cascade. However, in place of the propane cascade, it is also poassible to employ other refrigerating cycles, for example also a mixture cycle.

This first process stage, which is essentially concluded with the purificaton and precooling of the natural gas, is followed by a second process stage, namely the preliminary seapration of the natural gas. For this purpose, the partially liquefied natural gas is fed into a preliminary separation column 10 wherein components of the natural gas having a higher boiling point than methane are separated and fed, for processing purposes, via conduit 11 to a separating unit, not shown. The head product of the preliminary separation column, consisting substantially only of methane, ethane, as well as minor amounts of propane and butane, is withdrawn via conduit 12, partially condensed in heat exchangers 31 and 13, and subjected to a phase separation in the separator 14. The liquid fraction obtained in the separator 14 flows via conduit 15, as reflux, back into the preliminary separation column, at the top thereof.

The head product of separation column 10 is first cooled in heat exchanger 31 by the gaseous fraction from separator 14. The refrigeration required in heat exchanger 13 for the partial condenstion of the heat product is, as will be described in detail below, made available by cold vapor from the low-temperature stage of the process. Due to the fact that a relatively large amount of cold at a low temperature level is available in heat exchager 13, it is possible to product a relatively large quantity of reflux for the preliminary separation column. Consequently, the sump in the preliminary separation column can be heated very strongly by means of the heater 16. Accordingly, the reflux ratio in the column is generally about 0.01 : 1 to 0.1 : 1, especially 0.03 : 1to 0.04: 1. Thereby, the methane dissolved in the sump is extensively driven out, whereby the great advantage is attained that no additional methane separation is required any longer in the separating unit where the components of the high-boiling sump product are being processed.

The second stage of the process, characterized by the preliminary separation of the natural gas, is followed by the low-temperature stage, as the third stage, wherein the phase obtained as a gas in separator 14 and consisting essentially of metahne and minor amounts of ethane is liquefied. This gaseous fraction obtained in the separator 14 is withdrawn via conduit 17 an extensively liquefied in heat exchanger 18 in heat exchange with a vaporizing multicomponent gas or, if necessary, is also entirely liquefied and subcooled therein and then expanded into a separator 19 which is under slight excess pressure, e.g., about 1.1 to 2.0 ata . The liquid phase obtained in the separator 19 is withdrawn as the liquid product via conduit 20, and by way of valve 21, directly expanded into a storage tank 22 which is approximately under atmospheric pressure. The gaseous phase obtained in the separator 19 is withdrawn via conduit 23, warmed in heat exchanger 13 in heat exchange with condensing heat product from the preliminary separation column 10, and, after a further warming step in heat exchangers 6, 5 and 3, to approximately ambient temperature, is discharged from the plant and can be utilized, for example, as regenerating gas for absorbers. The excess pressure in the separator 19 is just sufficient to compensate for the pressure drop of the vapor fraction obtained in this separator while flowing through the individual heat exchanger cross sections. It proved to be advantageous to effect the expansion of the natural gas liquefied in heat exchanger 18 into the separator 19 by means of an ejector 24 and to connect the intake side of the ejector 24, via a conduit 25, with the vapor space of the storage tank 22. In this way, it is possible to make the cold of the vapor produced during the expansion of the liquid fraction obtained in separator 19 available for the plant without the complicated use of an additional cold blower wherein a portion of the cold is destroyed.

As mentioned above, the natural gas is liquefied in heat exchanger 18 in heat exchange with an evaporating multicomponent gas composed essentially of nitrogen, methane, ethane, and propane. The instant invention is not limited by the type of evaporation multicomponent gas utilized. By way of illustration, however, the following compositions of a multicomponent gas have been found satisfactory:

MULTICOMPONENT GAS

| Components | Suitable | Preferred |
|---|---|---|
| nitrogen | 8 – 18 Mol.-% | 12.0 Mol.-% |
| methane | 25 – 45 Mol.-% | 38.0 Mol.-% |
| ethane | 35 – 55 Mol.-% | 45.5 Mol.-% |
| propane | 1 – 8 Mol.-% | 4.4 Mol.-% |
| miscellaneous | 0 – 1 Mol.-% | 0.1 Mol.-% |

This multicomponent gas is compressed within a cycle in turbocompressor 26, cooled to approximately ambient temperature in the water cooler 27, partially liquefied in heat exchangers 3, 5 and 6 of the precooling stage, and fed to the heat exchanger 18. During this partial liquefaction only abut 40 to 65, preferably 44 to 50 volume % of the multicomponent gas is liquefied. In the cross section 28 of the heat exchanger 18, the multicomponent gas is liquefied, optionally subcooled, then expanded in valve 29, vaporized and partially warmed in cross section 30 in heat exchange with the multicomponent gas flowing in cross section 28, as well as with the natural gas to be liquefied, and thereupon directly recycled to the turbocompressor 26. This mixture cycle for producing the peak cold of the process is distinguished, in particular, by its simplicity. Due to the fact that the completed liquefaction of the mutlicomponent gas takes place in one stage, additional separators and expansion valves, as well as additional cross sections in heat exchanger 18 are eliminated, which is of great advantage especially when using wound heat exchangers. Furthermore, the mixture cycle does not contain any additional buffer volumes caused by other apparatus, so that the efficiency of the turbocompressor is not impaired, such turbocompressor being very sensitive to density fluctuations of the cycle gas due, for example, to such buffers and being unavoidable.

In order to adapt the natural gas to be liquefied to the temperature conditions ambient on the warm end of the heat exchanger 18, the natural gas is subjected, prior to entering the heat exchanger 18, to an intermediate warming step in heat exchanger 31, in heat exchange with here already partially condensing gaseous mixture from the head of the preliminary separation column 10.

The embodiment of FIG. 2 differs from that of FIG. 1 by a fourth process stage, namely a nitrogen-separating stage, which is required in case the natural gas to be liquefied is relatively strongly enriched with nitrogen. Identical parts of the apparatus bear the same reference numerals in FIG. 2 as indicated in FIG. 1.

According to FIG. 2, the separator 19 of FIG. 1 is replaced by the rectifying column 32. The natural gas, liquefied in heat exchanger 18, is now expanded, by means of the ejector 24, into the rectifying column 32, which latter is also operated under slight excess pressure, e.g., about 1.1 to 2.0 ata; prior to its expansion in heat exchanger 33, the natural gas is first utilized for heating the sump of the column 32. The liquefied product of the column, consisting essentially of methane, is withdrawn from the sump via conduit 34 and conducted, by means of valve 35, into a separator 36 which is under storage pressure, i.e., approximately under atmospheric pressure. The liquid fraction obtained in the separator 36 is fed to a storage tank, not shown herein, while the vapor is taken in by the ejector 24 via conduit 37. To produce the reflux in the preliminary separation column 10, the nitrogen-containing residual gas produced in the head of column 32 is used in this embodiment. The provision of the additional separator 36 is advantageous if the storage tank for the liquefied natural gas is not installed directly at the liquefaction site.

The cold required for the partial condensation of the head gas obtained in the preliminary separation column 10, i.e., for the production of the reflux of the preliminary separating column, is made available at last partially by the nitrogen-enriched enriched residual gas obtained in the head of the rectifying column.

As a specific example of the process of the liquefication of a low-boiling gas according to the invention, there is fed to the plant, via conduit 1, under a pressure of 43.8 atmospheres absolute and at a temperature of 311° K, 402,494 $Nm^3/h$ of natural gas to be liquefied, having the following composition:

| | |
|---|---|
| $N_2 + He$ | 6.09 mol-% |
| $CH_4$ | 83.27 mol-% |
| $C_2H_6$ | 6.91 mol-% |
| $C_3$-hydrocarbons | 2.16 mol-% |
| $C_4$-hydrocarbons | 0.90 mol-% |
| $C_5$-hydrocarbons | 0.30 mol-% |
| $C_{6+}$-hydrocarbons | 0.16 mol-% |
| $CO_2$ | 0.21 mol-% |
| $H_2O$ | 38 p.p.m. |

This natural gas is subjected to a $CO_2$ separation in unit 2 and cooled in heat exchanger 3 to 292.5° K. Thereupon, the natural gas is subjected to an $H_2O$ separation in the purifier 4 and cooled in heat exchangers 5 and 6 to 259.5° K and 237.2° K, respectively, thus condensing about 1,173 $Nm^3/H$ of the natural gas already at this point. The partially liquefied natural gas is then fed into the preliminary separating column 10.

In the sump of column 10, a liquid is obtained composed of:

| | |
|---|---|
| $CH_4$ | 0.45 mol-% |
| $C_2H_6$ | 25.25 mol-% |
| $C_3$-hydrocarbons | 31.20 mol-% |
| $C_4$-hydrocarbons | 31.23 mol-% |
| $C_5$-hydrocarbons | 7.80 mol-% |
| $C_{6+}$-hydrocarbons | 4.07 mol-% |

As shown by the composition of the sump product of separating column 10, substantially all of the methane is removed from the liquid portion in the separator 10. As previously explained, the cooling and partial liquefication of natural gas in heat exchanger 13 results in a relatively large liquid phase in separator 14 and reflux to the column 10. The liquid phase in column 10 may then be heated sufficiently to vaporize substantially all of the methane, simplifying the further treatment of the sump product. This liquid is fed, via conduit 11, to a separating unit, not shown herein.

The head product of the column 10, consisting essentially of:

| | |
|---|---|
| $N_2$ + He | 6.16 mol-% |
| $CH_4$ | 85.00 mol-% |
| $C_2H_6$ | 6.75 mol-% |
| $C_3$-hydrocarbons | 1.58 mol-% |
| $C_4$-hydrocarbons | 0.49 mol-% |
| $C_5$-hydrocarbons | 0.02 mol-% |

is cooled first in heat exchanger 31 to 230° K and then in heat exchanger 13 to 223.4° K, partially liquified during this step, and subjected to a phase separation in the separator 14. 11,899 $Nm^3/h$ of the liquid fraction obtained in separator 14 is recycled as reflux via conduit 15 into the column 10 with the following composition :

| | |
|---|---|
| $N_2$ + He | 0.90 mol-% |
| $CH_4$ | 39.51 mol-% |
| $C_2H_6$ | 26.73 mol-% |
| $C_3$-hydrocarbons | 20.88 mol-% |
| $C_4$-hydrocarbons | 11.63 mol-% |
| $C_5$-hydrocarbons | 0.34 mol-% |
| $C_{6+}$-hydrocarbons | 0.01 mol-% |

The gaseous fraction obtained in the separator 14 is composed essentially of:

| | |
|---|---|
| $N_2$ + He | 6.32 mol-% |
| $CH_4$ | 86.39 mol-% |
| $C_3$-hydrocarbons | 0.99 mol-% |
| $C_4$-hydrocarbons | 0.15 mol-% |
| $C_5$-hydrocarbons | 0.01 mol-% |

This fraction is withdrawn, at a temperature of 223.4° K, via conduit 17 and warmed in heat exchanger 31 to 232.1° K. Thereupon, this fraction is cooled to 124.7° K in heat exchanger 18 and partially liquefied during this step.

For illustration purposes, the example is relatively strongly enriched with nitrogen and will be further processed with respect to apparatus shown in FIG. 2.

After a further cooling in the heat exchanger 33 to about 118° K, the fraction is expanded by means of the ejector 24 to about 2 atmospheres absolute and fed into the rectifying column 32 at a temperature of 114.4° K.

The liquid fraction obtained in th sump of column 32 consists essentially of

| | |
|---|---|
| $N_2$ + He | 1.79 mol-% |
| $CH_4$ | 89.20 mol-% |
| $C_2H_6$ | 7.74 mol-% |
| $C_3$-hydrocarbons | 1.09 mol-% |
| $C_4$-hydrocarbons | 0.17 mol-% |
| $C_5$-hydrocarbons | 0.01 mol-% |

A part of this fraction is withdrawn via conduit 34, expanded to about 1.07 atmospheres absolute in valve 35, and subjected to a phase separation in the separator 36. The gaseous fraction produced in the separator 36, composed essentially of

| | |
|---|---|
| $N_2$ + He | 18.91 mol-% |
| $CH_4$ | 81.08 mol-% |
| $C_2H_6$ | 0.01 mol-% |

is fed via conduit 37 to the intake side of the ejector 24, recompressed therein to 2 atmospheres absolute, and theereafter recycled into the rectifying column 32.

As the liquid final product, 337,920 $Nm^3/h$ of the liquid fraction obtained in separator 36 is withdrawn from the plant, having the following composition:

| | |
|---|---|
| $N_2$ + He | 0.82 mol-% |
| $CH_4$ | 89.60 mol-% |
| $C_2H_6$ | 8.18 mol-% |
| $C_3$-hydrocarbons | 1.16 mol-% |
| $C_4$-hydrocarbons | 0.17 mol-% |
| $C_5$-hydrocarbons | 0.01 mol-% |

The head product from column 32, composed essentially of

| | |
|---|---|
| $N_2$ + He | 40.38 mol-% |
| $CH_4$ | 59.61 mol-% |
| $C_2H_6$ | 0.01 mol-% |

is warmed in heat exchanger 13 from 114.6° K to 223.1° K and, after further warming in heat exchangers 6, 5 and 3, leaves the plant via conduit 23.

The cold transfer to the natural gas takes place in the precooling zone, i.e., in heat exchangers 3, 5 and 6, by means of the three-stage propane cycle and, in the low-temperature cooling zone, i.e., in the heat exchanger 18, by means of the mixture cycle.

The propane cycle is well known in the art and details of its operation are found in the prior art, e.g. DOS 1,960,301. Referring to FIG. 3, the cycle is illustrated, the propane vapor from conduit 9, phase separators 43 and 45 being compressed in compressor 40 is then condensed by an external refrigerant in cooler 41, is pressure reduced in valve 42 and partially vaporized in precooler 7. The partially liquefied fluid is passed to phase separator 43 from where the liquid is further pressure reduced in valve 44 and passed into precooler 8. The resultant partially vaporzied propane is then passed to phase separator 45 from where the liquid is still further pressure reduced and vaporized in precooler 9.

In the mixture cycle, 861,660 $Nm^3/h$ of a multicomponent mixture consisting of:

| | |
|---|---|
| $N_2$ + He | 23.0 mol-% |
| $CH_4$ | 29.0 mol-% |
| $C_2H_6$ | 43.5 mol-% |
| $C_3$-hydrocarbons | 4.5 mol-% |

is compressed in the cycle compressor 26 to 42 atmospheres absolute and cooled in the water cooler 27 to about 302° K. Thereupon, the multicomponent mixture is cooled in heat exchangers 3, 5 and 6 against evaporating propane to about 237.2° K. During the step, already 366,236 $Nm^3/h$ or more than 40% of the multicomponent mixture is liquefied. In the cross section 28 of heat exchanger 18, the multicomponent mixture is further cooled against itself to 124.7° K. Thereafter, the mixture is expanded in expansion valve 29 to about 5 atmospheres absolute and fed at a temperature of about 121.6° K to the cross section 30 of the heat exchanger 18. Here, the multicomponent mixture is vaporized against itself and against the natural gas from heat exchanger 31 and warmed to 225° K. Subsequently, the mixture is reintroduced into the cold-intaking cycle of compressor 26.

As can be seen particularly from the descripion of the embodiments, the process of this invention is distinguished by great versatility. Thus, it is possible without difficulties to conduct the first two stages of the process, i.e., the purification and precooling as well as the preliminary separation, without the low-temperature cooling step, i.e., without the multicomponent mixture cycle. The additional refrigeration necessary for the preliminary separation is produced in this case by the expansion of the natural gas.

The process can also be utilized in a simple manner for the separation of higher-boiling hydrocarbons from natural gas, in case the liquid natural gas production has come to a standstill for some reason. In this case, it is merely necessary to cut off the multicomponent mixture cycle.

It is also possible to obtain, before the actual onset of the liquefaction, the gaseous components for the multicomponent mixture cycle directly within the plant itself, i.e., from the natural gas, without the additional expenditure of a further separating plant. This is also possible by the feature that no refrigeration is withdrawn from the multicomponent mixture cycle to produce the reflux for the preliminary separating column.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the at least partial liquefaction of a low-boiling gaseous mixture wherein the gaseous mixture under pressure is precooled in heat exchange with a vaporizing single-component refrigerant which flows in a first closed refrigeration cycle, purified during the course of the precooling step and, after the precooling step is subjected to a preliminary separation in a fractionating column to obtain a gaseous fraction, the improvement comprising:

precooling and partially liquefying to the extent of 40 to 65 volume % a closed cycle multicomponent gas refrigerant which flows in a second closed refrigeration cycle, in indirect heat exchange with said vaporizing single-component refrigerant, completing the liquefying of said multicomponent gas refrigerant by cooling in one heat exchange stage, by expansion of resultant completely liquiefied multi-component refrigerant against itself, and said expansion being conducted simultaneously in indirect heat exchange contact with the gaseous fraction obtained from said preliminary separation, to at least partially liquefy said gaseous fraction, said partial liquefaction being conducted at a temperature lower than the precooling step.

2. The process improvement according to claim 1 also including the step of compressing said multicomponent gas before said step of precooling and partially liquefying and wherein said step of completing the liquefying of said multicomponent gas at one stage includes evaporating said multicomponent gas in said one stage.

3. The process improvement according to claim 1 also including the steps of expanding said at least partially liquefied gaseous mixture to a slight excess pressure to obtain a liquid fraction and a vapor fraction, utilizing said vapor fraction for partial condensation of gaseous mixture obtained from the top of the fractionating column in said preliminary separation, and refluxing said liquid fraction to said fractionating column, the reflux ratio in said column being about 0.03 : 1 to 0.04 : 1.

4. The process improvement according to claim 3 wherein said step of expanding comprises passing said at least partially liquefied gaseous mixture through an ejector; and comprising the further steps of expanding said liquid fraction to about atmospheric pressure and storing same at said pressure, and passing vapor arising from the expansion of said liquid stored at about atmospheric pressure to the suction side of said ejector.

5. The process improvement according to claim 4 including the step of rectifying said liquid fraction at slight excess pressure and wherein said vapor fraction of said gaseous mixture utilized for said partial condensation is the overhead gas produced by said rectifying.

6. The process improvement according to claim 3 including the step of rectifying said liquid fraction at slight excess pressure and wherein said vapor fraction of said gaseous mixture utilized for said partial condensation is the overhead gas produced by said rectifying.

7. A process as defined by claim 1 wherein said low boiling gaseous mixture is natural gas, said singlecomponent refrigerant is propane, said multi-component gas comprises on a mol percent basis, nitrogen 8–18, methane 25–45, ethane 35–55, and propane 1–8.

8. A process as defined by claim 7 wherein said mutlicomponent gas comprises about 12.0 nitrogen, about 38.0 methane, about 45.5 ethane, and about 4.4 propane.

9. A process as defined by claim 7 wherein said multicomponent gas is liquefied to the extent of 44–15 volume percent.

10. A process for at least the partial liquefaction of a natural gas comprising:

precooling said natural gas in indirect heat exchange with a refrigerant which flows in a first closed cycle; subjecting said natural gas to a preliminary separation step to obtain a liquid and a gaseous fraction compressing a multicomponent gas which flows in a second closed cycle;

partially liquefying to the extent of 40 to 65 volume % said compressed multicomponent gas by precooling against an external refrigerant, completing the liquefying of said partially liquefied multicomponent gas by heat exchange with expanding previously liquefied multicomponent gas in a single heat exchanger stage, and simultaneously at least partially liquefying said gaseous fraction of natural gas by heat exchange with said expanding multicomponent gas in said single heat exchanger stage.

11. The process according to claim 10, wherein said external refrigerant is a three cascade stage propane cycle and the natural gas is precooled by heat exchange with said external refrigerant and wherein said step of partially liquefying said multicomponent gas by precooling is accomplished by heat exchange with said external refrigerant simultaneously with said precooling of the natural gas, and wherein said multicomponent gas completely evaporates during said single stage.

12. The process according to claim 11, wherein said preliminary separation of said precooled natural gas is conducted in a fractionating column to form a first vapor fraction, and a first liquid fraction, expanding in an ejector said natural gas at least partially liquefied in said single stage to a slight excess pressure, and cooling said first vapor fraction by heat exchange with said vapor fraction expanded to a slight excess pressure.

13. The process according to claim 12, wherein said cooled first vapor fraction is thereby partially liquefied and wherein said process includes the additional steps of:

separating said cooled first vapor fraction into a second vapor fraction and a second liquid fraction; and said second vapor fraction passing as said gaseous fraction of natural gas in indirect heat exchange with said expanding multicomponent gas in said single stage.

14. The process according to claim 12, wherein said process additionally includes the steps of:

refluxing said second liquid fraction into said fractionating columnm, the reflux ratio in said column being about 0.03 : 1 to about 0.04 : 1.

15. The process according to claim 14, also including the steps of:

separating said expanded gaseous mixture at least partially liquefied in said single stage into a third vapor fraction and a third liquid fraction;

storing said third liquid fraction; and passing vapor expanding from said step of storing to the suction side of said ejector.

16. The process according to claim 14, also including the steps of:

rectifying said expanded gaseous mixture at least partially liquefied in said single stage;

separating the sump product formed by said rectifying step into a third vapor fraction and a third liquid fraction; and passing vapor expanding from said step of storing to the suction side of said ejector.

* * * * *

UNITED STATES PATENT AND TRADEMARK OFFICE

CERTIFICATE OF CORRECTION

PATENT NO. : 3,970,441

DATED : July 20, 1976

INVENTOR(S) : VOLKER ETZBACH et al

It is certified that error appears in the above-identified patent and that said Letters Patent are hereby corrected as shown below:

Claim 6, line 1: "3" should be -- 4 --.

Claim 9, line 2: "44-15" should be -- 44-50 --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*